US006865833B2

(12) United States Patent
Kliakhandler et al.

(10) Patent No.: US 6,865,833 B2
(45) Date of Patent: Mar. 15, 2005

(54) VISUAL DISPLAY INCLUDING LINKED BUBBLES

(75) Inventors: Igor Kliakhandler, Houghton, MI (US); Robert W. Sheldon, Chicago, IL (US)

(73) Assignee: Board of Control of Michigan Technological University, Houghton, MI (US)

( * ) Notice: Subject to any disclaimer, the term of this patent is extended or adjusted under 35 U.S.C. 154(b) by 0 days.

(21) Appl. No.: 10/287,361

(22) Filed: Nov. 4, 2002

(65) Prior Publication Data

US 2003/0084598 A1 May 8, 2003

Related U.S. Application Data

(60) Provisional application No. 60/337,302, filed on Nov. 5, 2001.

(51) Int. Cl.[7] ..... G09F 19/00
(52) U.S. Cl. ..... 40/406; 40/441
(58) Field of Search ..... 40/406, 407, 408, 40/439, 441, 477; 362/96, 101; 434/126; 446/15, 21, 267

(56) References Cited

U.S. PATENT DOCUMENTS

| | | | | | |
|---|---|---|---|---|---|
| 3,706,149 | A | * | 12/1972 | Olivieri | 40/407 |
| 4,085,533 | A | * | 4/1978 | Ewald | 40/406 |
| 4,419,283 | A | * | 12/1983 | Schneider | 252/600 |
| 5,211,469 | A | | 5/1993 | Matthias et al. | |
| 5,476,068 | A | | 12/1995 | Townsend | |
| 5,737,860 | A | | 4/1998 | Whigham et al. | |
| 6,065,850 | A | | 5/2000 | Chiu | |
| 6,070,348 | A | | 6/2000 | Bianchetti | |
| 6,135,604 | A | | 10/2000 | Lin | |
| 6,187,394 | B1 | * | 2/2001 | Johnson et al. | 428/13 |
| 6,193,578 | B1 | | 2/2001 | Weber | |
| 6,295,749 | B1 | | 10/2001 | Lin | |
| 6,416,197 | B1 | * | 7/2002 | Chang | 362/96 |
| 6,550,167 | B2 | * | 4/2003 | Huang | 40/406 |
| 2002/0116847 | A1 | * | 8/2002 | Yen | 40/406 |

FOREIGN PATENT DOCUMENTS

| | | |
|---|---|---|
| DE | G 87 04 444.7 | 9/1987 |
| DE | 100 19 746 A1 | 10/2001 |

OTHER PUBLICATIONS

R. Clift, J. R. Grace & M. E. Weber; Bubbles, Drops, and Particles, 1978; pp. 26–27; Academic Press.

R. Byron Bird, Robert C. Armstrong & Ole Hassger; Dynamics of Polymeric Liquids, Fluid Mechanics vol. 1, Second Edition; 1987; pp. 83–86; John Wiley & Sons.

(List continued on next page.)

*Primary Examiner*—Andrew Wright
(74) *Attorney, Agent, or Firm*—Michael Best & Friedrich LLP

(57) ABSTRACT

A visual display including a container, liquidous fluid within the container, a source of gaseous fluid communicating with the liquidous fluid, and at least one binary bubble formed within the liquidous fluid in response to gaseous fluid entering the liquidous fluid. The liquidous fluid is preferably a polymer in water solution or a polymer in mineral oil or silicon oil solution. The binary bubble has two bulbous portions in fluid communication with each other through a neck. The binary bubbles may link together in a chain extending from the bottom of the container to the top of the liquidous fluid. In other constructions, the binary bubbles float up through the liquidous fluid and collapse into a large individual bubble. The display may also include a light emitting source and a filter for selectively changing the color of light emitted into the container.

25 Claims, 6 Drawing Sheets

OTHER PUBLICATIONS

Hasan N. Oguz & Andrea Prosperetti; Dynamics of bubble growth and detachment from a needle; Journal of Fluid Mechanics, vol. 257; Dec. 1993; pp. 111–145; Cambridge University Press.

L. Van Wijngaarden; Hydrodynamic interaction between gas bubbles in liquid; Journal of Fluid Mechanics, vol. 77, 1976; pp. 27–44; Cambridge University Press.

R. Krishna & J. M. Van Baten; Simulating the motion of gas bubbles in a liquid; NATURE weekly journal, vol. 398; Mar. 18, 1999; pp. 208.

D. De Kee, R. P. Chhabra & A. Dajan; Motion And Coalescence Of Gas Bubbles In Non–Newtonian Polymer Solutions; Journal of Non–Newtonian Fluid Mechanics, vol. 37 (1990); pp. 1–18; Elsevier Science Publishers B. V.

D. Rodrigue, D. De Kee, C. F. Chan Man Fong; An experimental study of the effect of surfactants on the free rise velocity of gas bubbles; Journal of Non–Newtonian Fluid Mechanics, vol. 66 (1996); pp. 213–232; Elsevier.

* cited by examiner

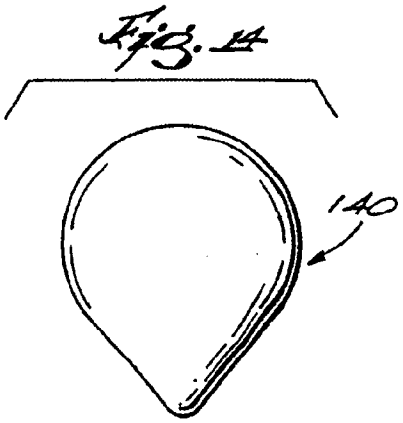
Fig. 14
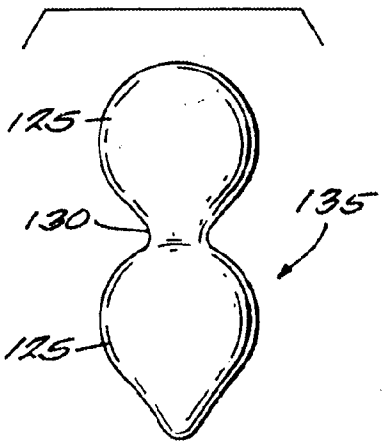
Fig. 13
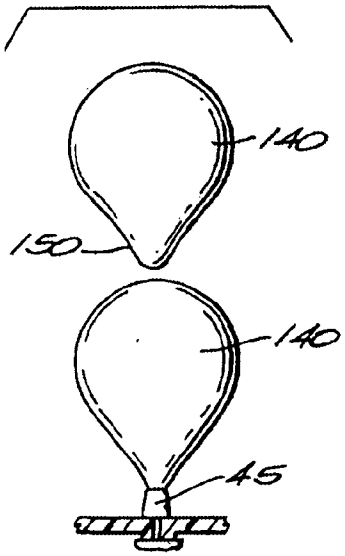
Fig. 12
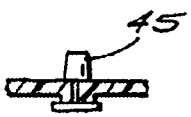
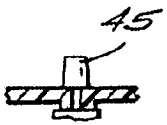

VISUAL DISPLAY INCLUDING LINKED BUBBLES

This application claims the benefit of U.S. Provisional Patent Application No. 60/337,302, filed Nov. 5, 2001, the entire contents of which are incorporated herein by reference.

FIELD OF THE INVENTION

The present invention relates to a visual display that includes two or more linked bubbles.

SUMMARY OF THE INVENTION

The present invention provides a visual display that includes a container, a liquidous fluid within the container, a source of gaseous fluid, and at least one binary bubble formed within the liquidous fluid. The binary bubble is formed in response to the source of gaseous fluid introducing gaseous fluid into the liquidous fluid. The binary bubble has at least two bulbous portions and a neck communicating between the bulbous portions.

The liquidous solution may include, for example, a solution of a polymer in water, a solution of polymer in mineral oil, or silicon oil, and is a non-Newtonian fluid. A plurality of binary bubbles may link together in a chain extending the height of the container. The binary bubbles may also collapse into a single bubble.

The display may also include a light source and a filter for changing the frequency of light emitted into the container. A patterned member may be applied to the container such that the pattern is reflected in the bubbles as they float up through the liquidous fluid.

Other features of the invention will become apparent to those skilled in the art upon review of the following detailed description, claims, and drawings.

BRIEF DESCRIPTION OF THE DRAWINGS

FIGS. 12–14 are side views of a pair of single bubbles joining into a binary bubble and then a single bubble.

Figure 1:
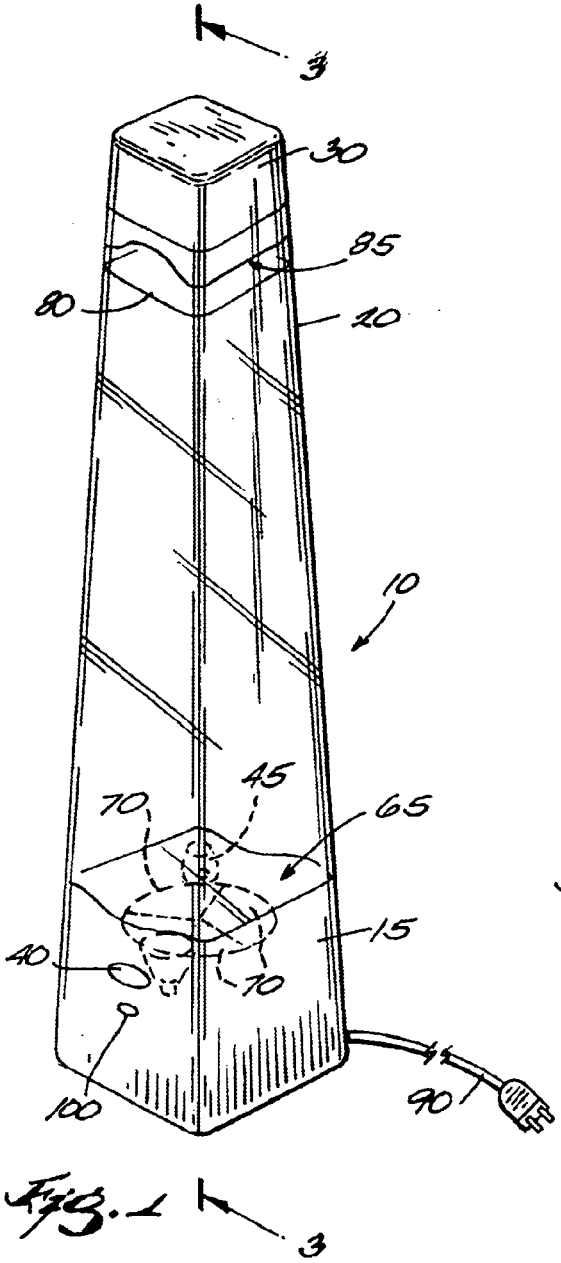
FIG. 1 is a perspective view of a first construction of a visual display embodying the invention.
Figure 2:
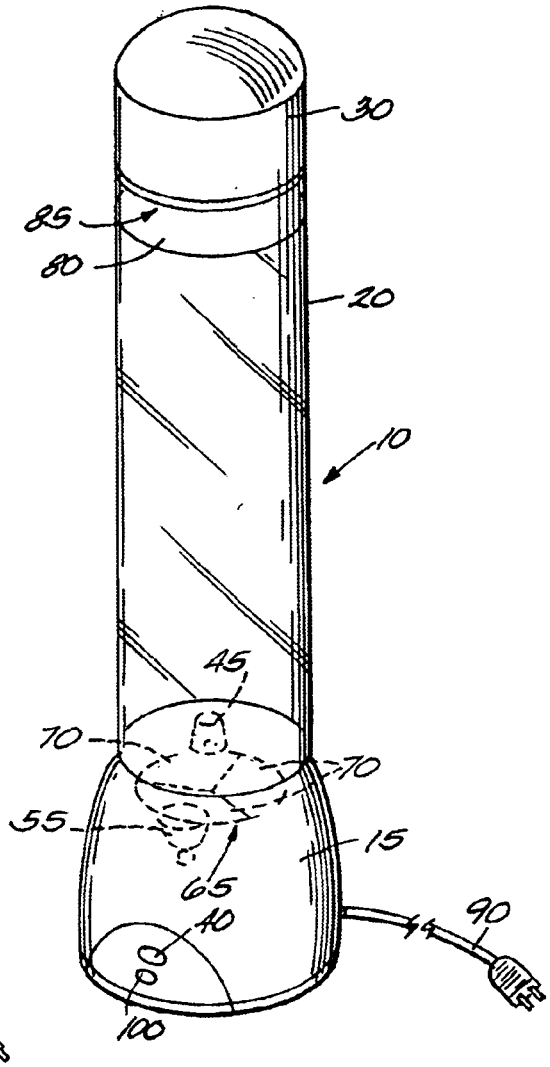
FIG. 2 is a perspective view of a second construction of the visual display.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIGS. 1–4 illustrate a display 10 that includes a base 15, a container 20, a liquidous fluid 25 (FIG. 3) within the container 20, a valve 30 (FIG. 4) in the top of the container 20, a pump 35 within the base 15, one or more control switches 40, a nozzle 45 communicating with an orifice in the bottom of the container 20, a tube 50 fluidly interconnecting the pump 35 and the nozzle 45, a light emitting source 55, a motor 60, a rotatable member 65 supporting or defining a plurality of light filters 70, and an optional CPU 75.

The base 15 is preferably a plastic or metal structure that contains the pump 35, light source 55, motor 60, rotatable member 65, and CPU 75. The base 15 supports the container 20, which is illustrated as frusto-pyramidal in FIG. 1 and tubular in FIG. 2, but may be substantially any other shape as well. The liquidous solution 25 is preferably a non-Newtonian solution, and may be for example, a polymer and water solution, a polymer and mineral oil solution, or viscous silicon oil. The liquidous solution preferably has a viscosity of at least 3000 centapoise at near zero shear rate. The significance of the characteristics of the liquidous solution 25 will be discussed in greater detail below. The liquidous solution 25 does not fill the entire container 20, but rather defines a free surface or fill line 80 below the top of the container 20. Between the free surface 80 and the top of the container is a free space 85 occupied by air.

Figure 4:
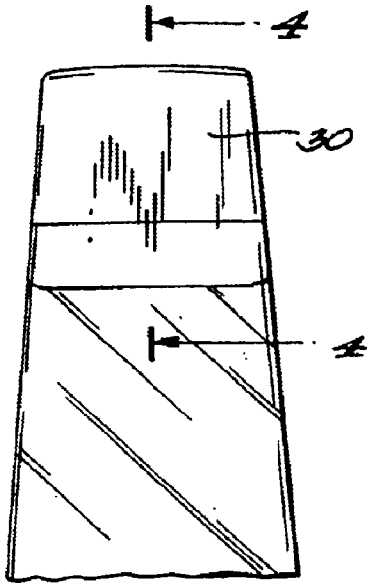
FIG. 4 is an enlarged cross-section view of the top of the display taken along line 4—4 in FIG. 3.
Figure 4:
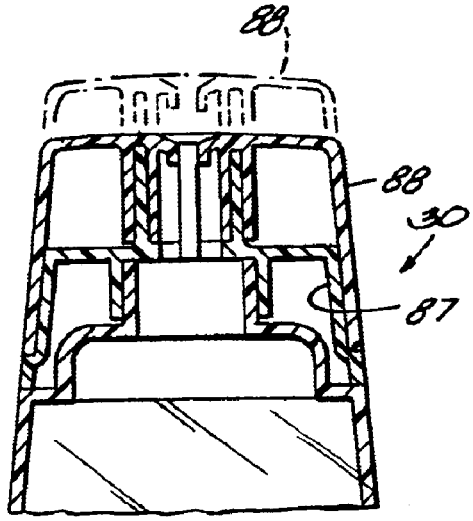
Figure 3:
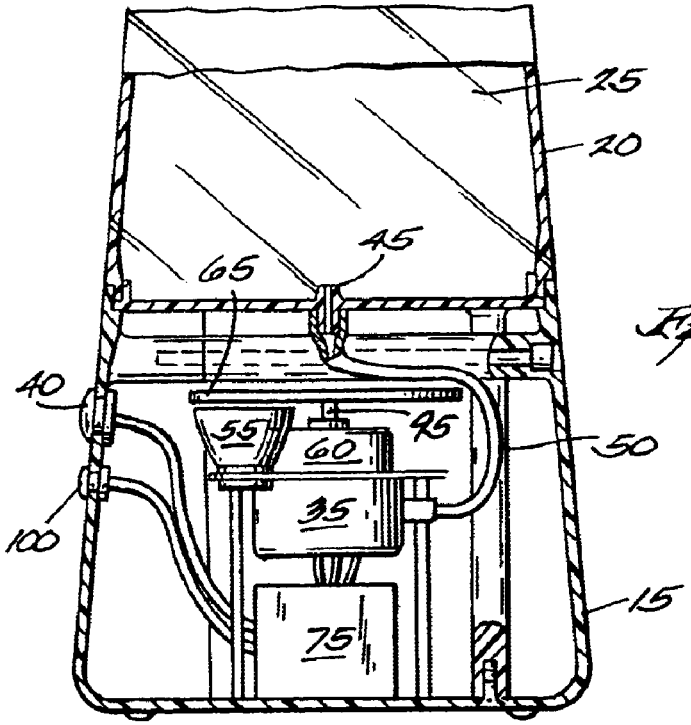
FIG. 3 is a cross-section view of the display taken along line 3—3 in FIG. 1.

As best seen in FIG. 4, the valve 30 defines the top of the container 20, and includes a bottom 87 and a cap 88. The cap 88 is movable with respect to the bottom 87 between a closed position (illustrated in solid lines) and an open position (illustrated in phantom). When the cap 88 is in the closed position, fluids are not permitted to flow out of the container 20 through the valve 30. The valve 30 is intended to be closed when the display 10 is being shipped or otherwise moved with the liquidous fluid 25 within the container 20 or when the display 10 is not in operation to reduce the likelihood of leakage. When the cap 88 is in the open position, fluids (e.g., air) are permitted to escape the container through the valve 30. The valve 30 is intended to be open during operation of the display 10 to vent the air being pumped into the container 20 by the pump 35, as will be described in more detail below.

The pump 35 preferably operates on electricity provided through a power cord 90, or alternatively through batteries in the base (in which case the cord would not be necessary). The pump 35 may be of the type using a diaphragm (e.g., the type often used to aerate fish aquariums), a piston, or a screw compressor to pressurize air and force it through the tube 50 and out the nozzle 45. Alternatively, the pump 35 may pressurize gaseous fluid other than air and introduce that fluid into the liquidous fluid. In other constructions, the pump 35 may be replaced with a container of pressurized gaseous fluid and a valve for selectively releasing the pressurized fluid at a desired rate. Alternatively, the gaseous fluid may be replaced with a liquidous fluid, provided it has a lower density than the liquidous solution in the container so that it raises through the container 20 like a bubble of air.

The control switch 40 is rotatable or otherwise actuable to vary the operating speed of the pump 35 and to thereby control the pressure and flow rate of air flowing out of the pump 35 and into the tube 50. The control switch 40 may control the amount of electricity that is provided to the pump 35, and thereby control the operating speed of the pump. Alternatively, the control switch 40 may be wired to the CPU 75 and the CPU 75 may control the pump based on the setting of the control switch 40.

The motor 60 also operates on electricity provided through the power cord 90 or by batteries, and includes a rotatable output shaft 95 (FIG. 3) that supports the rotatable member 65. The light source 55, which is powered by electricity through the power cord or by batteries, emits white light under the rotatable member 65. The light source may be for example a halogen light, an LED, or an incandescent light. As the rotatable member 65 rotates under the influence of the motor 60, the various filters 70 are sequentially positioned between the light source 55 and the bottom of the container 20. Each filter 70 permits only selected light frequencies to pass through, which causes the liquidous fluid 25 in the container 20 to be illuminated a different color.

As an alternative to the white light and filters assembly described above, the display may include a bank of LED's or a plurality of other light sources emitting light at selected frequencies. The CPU 75 may be programmed to illuminate the light sources in a scheme, pattern, or sequence of colors to best fit the mood being conveyed. The CPU 75 may be preprogrammed with several different illumination sequences, for example, and a second switch 100 (FIGS. 1–3) may be wired to the CPU 75 and control which lighting sequence is to be used.

The CPU 75 may also be programmed to selectively play music during operation of the display 10. Because the bubbles (discussed in detail below) floating up through the liquidous fluid 25 are linked together in a chain or are generally in the shape of miniature hot air balloons, the CPU 75 may be programmed to play music relating to the themes of chains or hot air balloons. If the programmed color scheme is used, it can be coordinated with the music to enhance the overall effect. The second switch 100 may be used to select the music to be played as well.

As mentioned above, the liquidous solution 25 may include several different solutions, and the bubbling phenomenon created within the container 20 may be varied based on the composition of the liquidous solution 25. For the purpose of providing examples, the liquidous solution falls into two basic categories: (1) a polymer in water solution; and (2) a polymer in oil solution. Both categories produce at least two bubbles that are at least temporarily linked together through a neck providing communication between the bubbles.

EXAMPLE 1

Polymer in Water Solutions

A chain of linked, relatively small bubbles extending from the nozzle 45 to the free surface 80 was created in liquid soap (consisting of a polymer in water solution) and in solutions of 2–3% METHOCEL (F4M hydroxypropyl methylcellulose) in water. METHOCEL is a trademark of the Dow Chemical Company.

With reference to FIGS. 5–8, here is how the chain of bubbles 105 was formed. The pump 35 introduces pressurized air into the liquidous fluid 25 in the container 20, thereby creating a large leading bubble 110. The leading bubble 110 rises in the liquidous solution 25 at a rate of 15 cm/sec in a 2% METHOCEL (F4M hydroxypropyl methylcellulose) solution and at a rate of 8 cm/sec in a 3% METHOCEL (F4M hydroxypropyl methylcellulose) solution. Because of the viscosity and the non-Newtonian (especially elastic) properties of the liquidous fluid, the trailing edge 115 of the leading bubble does not separate immediately from the nozzle 45. Rather, a neck or pipe 120 forms between the nozzle 45 and the leading bubble 110. The process of fast contraction of the air pipe 120 is mitigated by the elastic properties of the liquid.

The air pump 35 fills the pipe 120 with air, thereby creating a plurality of bubbles or bulbous portions 125 linked together by necks 130. More specifically, the Rayleigh instability caused by the tendency of surface tension between the air and the liquid to diminish the area of the cylindrical pipe 120 results in the appearance of the periodic bubble-like or bulbous structures in the chain 105. The chain 105 may be viewed as a plurality of binary bubbles that are linked together, with each binary bubble including first and second bulbous portions 125 interconnected with a neck 130. The whole process of formation of the bubble chain 105 is quite fast, from substantially immediately (in less viscous solutions) to about 10 seconds (in more viscous solutions). The elastic effects of the liquidous solution resist the collapse of the necks 130 and detachment of the bulbous portions 125 from the chain 105. The large leading bubble 110 carries the chain of bulbous portions 105 to the free surface 80.

The minimum flow rates of air to establish and maintain the chain of bubbles 105 in 2% and 3% METHOCEL (F4M hydroxypropyl methylcellulose) solutions was found to be 3.7 and 2.3 cubic centimeters per second, respectively. The whole chain structure 105 was observed to disintegrate substantially immediately upon turning off the air supply.

Each bulbous portion 125 in the chain 105 moves up one place as a new bulbous portion 125 is created at the bottom of the chain 105 and as the top bulbous portion 125 breaks through the free surface 80 and bursts. The rate of ascent or velocity of the bulbous portions 125 in the chain 105 was found to be 4 cm/sec in a 2% METHOCEL (F4M hydroxypropyl methylcellulose) solution and 0.7 cm/sec in a 3% METHOCEL (F4M hydroxypropyl methylcellulose) solution. Some air moves between the bulbous portions 125 in the chain 105. This movement of air between bulbous portions 125 is noticeable as the donor bulbous portion 125 shrinks in size and the recipient bulbous portion 125 bulges.

The amount of air flowing through the necks 130 between bulbous portions 125 can be estimated by comparing the rate at which air is vented to the free space 85 due to bulbous portions 125 breaking through the free surface 80 to the rate at which the pump 35 introduces air into the chain 105. The length of the bulbous portions in 2% METHOCEL (F4M hydroxypropyl methylcellulose) solution is about 0.8 cm, with about 5 mm in cross-section. The volume of the bulbous portions is therefore approximately 0.9 cubic centimeters. Rounding the length of the bulbous portions up to 1 cm, and with a 4 cm/sec rate of ascension, approximately 4 bulbous portions reach the free surface each second, carrying approximately 3.6 cubic centimeters of air in them. Assuming the air pump 35 is operating at the minimum flow rate of 3.7 cubic centimeters per second, only 0.1 cubic centimeters passes through the necks 130 each second.

Figure 8:
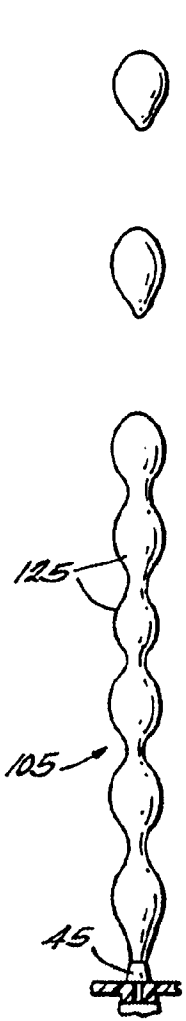
FIGS. 5–8 are side views of a bubble chain forming within the display.
Figure 7:
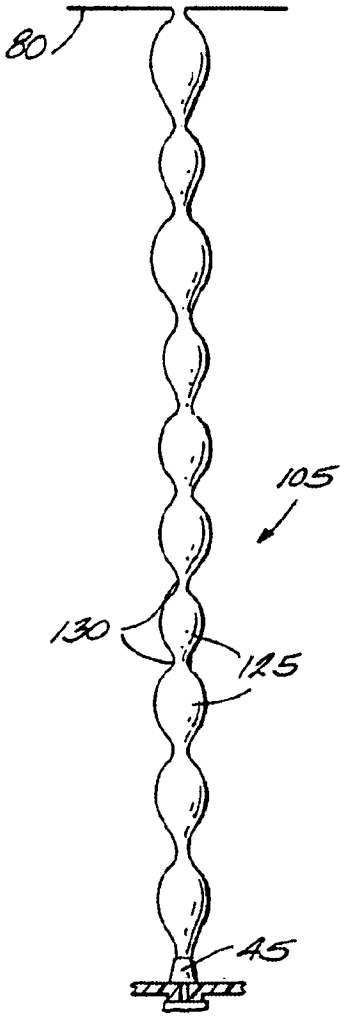
Figure 6:
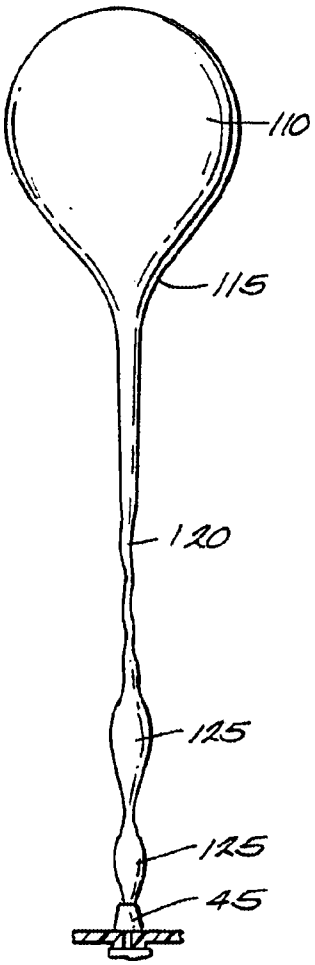
Figure 5:
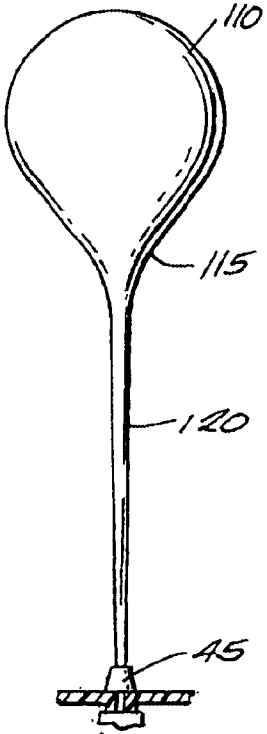

Depending on the flow rate of the air pump 35 and the type of liquidous solution, a partial bubble chain may form, as seen in FIG. 8. Periodically, the top bulbous portion will separate from the partial bubble chain 105 and float up to the free surface 80 as an individual bubble. The partial bubble chain 105 is semi-unstable, but still maintains the basic bubble chain structure.

The phenomenon of linked bubbles was not observed in concentrations of METHOCEL (F4M hydroxypropyl methylcellulose) smaller than 2%. The bulbous portions 125 in the chain were observed to be smaller in the liquid soap solutions than in the METHOCEL (F4M hydroxypropyl methylcellulose) solutions (which bubbles were on the order of 1 cm in length). Bulbous portions in 2% solution are more elongated and move faster than in 3% solution.

Further experiments were conducted to elucidate the mechanism of bubble chain 105 formation. First, bubbling experiments were conducted with corn syrup, which is a Newtonian liquid having a viscosity similar to METHOCEL (F4M hydroxypropyl methylcellulose). Extensive experiments with corn syrup did not uncover any circumstances under which a chain of bubbles would form. The underlying reason is that the air pipe 120 either disintegrates or is never formed behind bubbles in Newtonian liquids. Rather, surface tension leads to successful contraction of the air pipe 120 into globules and usual bubbling occurs.

Next, a visual study of elongational properties of METHOCEL (F4M hydroxypropyl methylcellulose) solution and soap was conducted. This study reveals a remarkably different behavior of those two classes of liquids. A drop of liquid soap detaches relatively quickly from the bulk of the liquid but leaves a very thin and long thread of soap behind. Solutions of METHOCEL (F4M hydroxypropyl methylcellulose) behave in an entirely opposite way in this type of test. The drop of METHOCEL (F4M hydroxypropyl methylcellulose) solution may hang up to a minute, and when it finally does fall it does not form any intermediate drops or threads. Since the chain of bubbles 105 may be formed both in soap and METHOCEL (F4M hydroxypropyl methylcellulose) solutions, this comparison suggests that elongational properties of the liquid are probably not critically important to the formation of a chain of bubbles.

Next, surface tension was considered. METHOCEL (F4M hydroxypropyl methylcellulose) acts as a surfactant, substantially reducing surface tension of its solutions compared to that in pure water. The rheological properties of 2% and 3% METHOCEL (F4M hydroxypropyl methylcellulose) solutions were measured using a Rheometric Scientific rheometer with parallel, 50 mm diameter plates and a gap of about 1 mm, at 25 degrees Celsius.

Both steady-shear and oscillatory tests were conducted for each sample. A strain sweep experiment was performed prior to each oscillatory experiment to determine the linear viscoelastic regime. For steady-shear experiments, an equilibration time of 10 seconds was given at each shear rate to allow the system to reach steady state. The time-sweep and repeated steady-state experiments did not reveal any thixotropic (time-dependent) behavior of the studied METHOCEL (F4M hydroxypropyl methylcellulose) solutions.

The METHOCEL (F4M hydroxypropyl methylcellulose) solutions were then tested for linear viscoelastic dynamic response to small-amplitude oscillatory shear. The test data suggest that the METHOCEL (F4M hydroxypropyl methylcellulose) solutions have a broad spectrum of relaxation times, and probably, broad distribution of molecular weights.

Last, the METHOCEL (F4M hydroxypropyl methylcellulose) solutions show a fairly common polymeric rheological behavior in general. It may therefore be expected that many concentrated polymeric solutions will exhibit the formation of a chain of bubbles 105.

EXAMPLE 2

Polymer in Oil Solutions

Relatively large, fat bubbles were created in mineral oil and viscous silicon oil solutions. The bubbles took on the shape of miniature hot air balloons, with a bulbous leading portion and a tapered, pointed trailing portion. Periodically, a binary bubble would emerge from the air nozzle. The binary bubble would have two bulbous portions in fluid communication through a neck portion. Also, individual bubbles were observed to merge as a slightly larger bubble caught up with a smaller bubble.

One mineral oil solution includes a material from the Lubrizol Company of Wickliffe, Ohio. The product name of the Lubrizol material is OS#177623. The Lubrizol material contains a proprietary blend of mineral oil and a polymer. The liquidous solution in this example includes (by weight) about 79% Lubrizol material and about 21% mineral oil. The liquidous solution has been observed to become stiffer (e.g., achieving a higher viscosity) over time, probably due to additional polymer cross-linking over time. The mixing and stiffening process may be hastened by mixing the Lubrizol material with the mineral oil in a double boiler. A solution of 5–10% polymer (e.g., ethylene propylene copolymer or acrylic polymer) with about 90–95% mineral oil may be used as an alternative to using the Lubrizol material. Another mineral oil solution that may be used is polybutene, sold under the trademark Indopol H-40 by the Amoco Chemical Company, Chicago, Ill.

FIGS. 9–14 illustrate the observed formation and behavior of a binary bubble 135 in the mineral oil solutions and in the viscous silicon oil. With referenced to FIGS. 9–11, the pump 35 introduces air into the liquidous solution 25 and forms a first bulbous portion 125. The viscosity and non-Newtonian (especially elastic) properties of the liquidous solution 25 cause a neck 130 to be formed, as described above, and then a second bulbous portion 125 emerges from the nozzle 45. The first and second bulbous portions 125 are in fluid communication with each other through the neck 130. The bubble may be termed a binary bubble 135 due to the bubble including at least first and second bulbous portions 125. The binary bubble 135 may include more than two bulbous portions 125 (as in the bubble chain 105 described above), but those witnessed in the oil solutions typically include only two bulbous portions 125.

Figure 11:
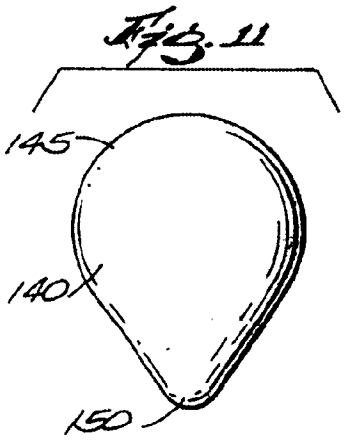
FIGS. 9–11 are side views of a binary bubble turning into a single bubble.
Figure 10:
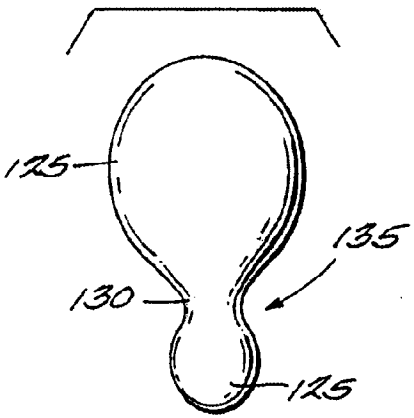
Figure 9:
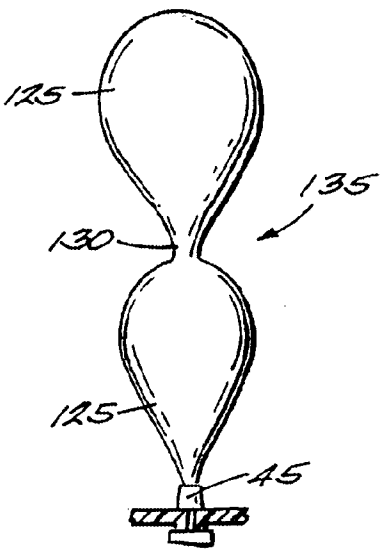

As seen in FIGS. 10 and 11, once the binary bubble 135 is free from the nozzle 45, the air in the second bulbous portion 125 flows into the first bulbous portion 125 through the neck 130. This results in the first bulbous portion 125 consuming the second bulbous portion 125, and the binary bubble 135 transforming into a single large bubble 140. The single large bubble 140 has a large bulbous leading end 145 and a trailing end 150 that tapers down to look similar to the bottom of a hot air balloon. This single bubble 140 floats up through the liquidous solution 25 and eventually bursts when it breaks through the free surface 80. Alternatively, some of the binary bubbles 135 may break apart before the lower bulbous portion 125 is consumed by the upper bulbous portion 125. This results in two single bubbles 140 floating up through the liquidous solution 25.

As seen in FIGS. 12–14, a single bubble 140 may overtake a smaller single bubble 140 to create a binary bubble 135 and then an even larger single bubble 140. Although the pump produces a nominally constant flow of air into the liquidous fluid 25, the bubbles 140 will have slightly different volumes. Also, when a binary bubble 135 collapses into a large single bubble 140, the so-created single bubble 140 will typically have a larger volume than a single bubble 140 emerging directly from the nozzle 45. In the event a lower bubble 140 has a larger volume than an upper bubble 140, the lower bubble 140 will overtake the upper bubble 140, and the pointed end 150 of the upper bubble 140 turns into a neck 130 between the two bubbles 140 and transforms the two bubbles into a binary bubble 135. Then the lower bubble 140 (which is now the lower bulbous portion 125 of the binary bubble 135) is consumed in the upper bubble 140 (FIG. 14) as described above.

The bubble sizes in the mineral oil solutions were found to be substantially the same as the bubble sizes in the viscous silicon oil for a given air flow rate. The bubbles in the viscous silicon oil were observed to be more rounded than those in the mineral oil solutions for a given air flow rate.

Figure 15:
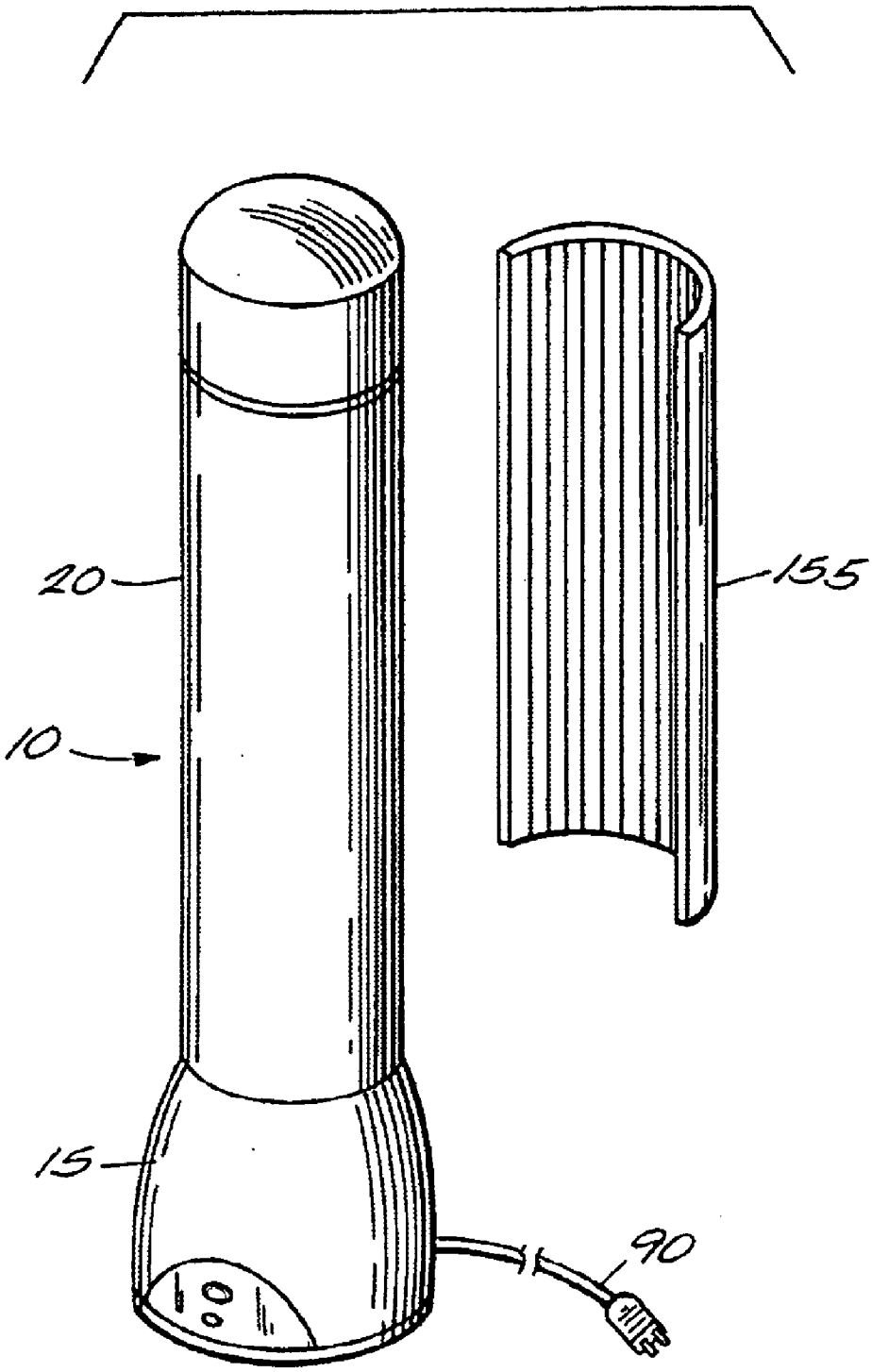
FIG. 15 is a partially exploded view of the display in combination with an optional patterned member.

FIG. 15 illustrates the additional feature of a patterned member 155 that may be included in the display 10. The patterned member 155 has a shape corresponding to the contours of the container 20 such that the patterned member 155 can be affixed to the outside of the container 20. Alternatively, the patterned member 155 may be affixed inside the container. The patterned member 155 may extend halfway or 180° around the container 20. The patterned member 155 includes a selected pattern, such as vertical stripes of different colors or a surface texture. The pattern on the patterned member 155 is reflected in the bubbles as they float up through the container. For example, the bubbles in the oil solutions have the general shape of hot air balloons, and the pattern can further enhance the illusion of miniature hot air balloons in the container 20. Any other pattern besides those suggested above may be used as well, such as horizontal or diagonal stripes, or any other pattern that would be visually pleasing when reflected in the bubbles.

Various features of the invention are set forth in the following claims.

What is claimed is:

1. A visual display comprising:

a container;

a liquidous fluid within the container;

a source of gaseous fluid communicating with said liquidous fluid for the introduction of the gaseous fluid thereinto; and at least one binary bubble formed within said liquidous fluid in response to said gaseous fluid entering said liquidous fluid, said binary bubble containing said gaseous fluid and having at least two bulbous portions and a neck communicating between said bulbous portions;

wherein said liquidous fluid includes a non-Newtonian solution.

2. The display of claim 1, wherein said non-Newtonian solution includes viscous silicon oil.

3. The display of claim 1, wherein said non-Newtonian solution includes a polymer solution.

4. The display of claim 1, wherein said non-Newtonian solution includes a solution of F4M hydroxypropyl methylcellulose in water.

5. The display of claim 4, wherein said liquidous fluid includes a solution of between 2% and 3% F4M hydroxypropyl methylcellulose in water.

6. The display of claim 1, wherein said non-Newtonian solution includes a polymer in oil solution.

7. The display of claim 6, wherein said liquidous fluid includes a solution of between 5% and 10% polymer in mineral oil.

8. A visual display comprising:

a container;

a liquidous fluid within the container;

a source of gaseous fluid communicating with said liquidous fluid for the introduction of the gaseous fluid thereinto; and at least one binary bubble formed within said liquidous fluid in response to said gaseous fluid entering said liquidous fluid, said binary bubble containing said gaseous fluid and having at least two bulbous portions and a neck communicating between said bulbous portions;

wherein said liquidous fluid has a viscosity of at least 3000 centapoise at near zero shear rate.

9. A visual display comprising:

a container;

a liquidous fluid within the container;

a source of gaseous fluid communicating with said liquidous fluid for the introduction of gaseous fluid thereinto; and at least one binary bubble formed within said liquidous fluid in response to said gaseous fluid entering said liquidous fluid, said binary bubble containing said gaseous fluid and having at least two bulbous portions and a neck communicating between said bulbous portions;

wherein the liquidous solution defines a free surface, and wherein said at least one binary bubble includes a plurality of binary bubbles in fluid communication with each other through a plurality of neck portions, said binary bubbles defining a linked chain of bulbous portions and necks extending from the source of gaseous fluid to the free surface and providing substantially uninterrupted fluid communication between the source of gaseous fluid and the free surface.

10. The visual display of claim 9, wherein each of the plurality of bulbous portions has a size substantially equal to the size of the other bulbous portions.

11. A visual display comprising:

a container;

a liquidous polymer solution in the container;

an orifice communicating with the inside of the chamber a pump operable to pump air through the orifice and into the container; and a chain of linked bulbous portions defined in the solution and formed in response to operation of the pump, the chain of linked bulbous portions including a plurality of bulbous portions interconnected by a plurality of necks, each bulbous portion fluidly communicating with all other bulbous portions in the chain and with the orifice through the necks.

12. The visual display of claim 11, wherein the liquidous polymer solution includes a non-Newtonian fluid.

13. The visual display of claim 11, wherein the orifice is positioned at the bottom of the container and wherein the bulbous portions in the chain move upwardly through the liquidous solution.

14. The visual display of claim 11, wherein at least one of said bulbous portions in said chain disconnects from said chain to form an individual bubble.

15. The visual display of claim 11, wherein each bulbous portion in the chain has substantially the same size.

16. The visual display of claim 11, wherein the liquidous solution defines a free surface, and wherein the chain defines a substantially continuous column of air that extends from the orifice to the free surface.

17. The visual display of claim 16, wherein the air flows toward the free surface faster than the bulbous portions in the chain move toward the free surface, such that air in one bulbous portion moves through the neck to the adjacent bulbous portion.

18. A method for making a visual display, the method comprising the steps of:

creating a liquidous solution having non-Newtonian properties;

at least partially filling a container with the liquidous solution;

introducing a flow of gaseous fluid into the solution;

forming first and second bubbles in the liquidous solution in response to the introduction of the gaseous fluid into the liquidous solution; and forming a first neck extending between the first and second bubbles.

19. The method of claim 18, further comprising the steps of repeating said forming steps to define a chain of bubbles linked to one another by the necks.

20. The method of claim 19, further comprising detaching at least one bubble from the chain and floating the detached bubble up through the liquidous solution.

21. The method of claim 19, further comprising extending the chain of bubbles upwardly through the liquidous solution until the chain communicates with a free surface of the liquidous solution.

22. The method of claim 21, further comprising moving each bubble in the chain upwardly and bursting each bubble as it breaks through the free surface.

23. The method of claim 18, further comprising detaching the first and second bubbles from the flow of gaseous fluid with the first and second bubbles communicating through the first neck to define a binary bubble.

24. The method of claim 23, further comprising transferring gaseous fluid from the second bubble into the first bubble, thereby decreasing the size of the second bubble and increasing the size of the first bubble.

25. The method of claim 23, further comprising entirely collapsing said first and second bubbles together to define a single bubble.

* * * * *